US011795634B2

(12) United States Patent
Lyu et al.

(10) Patent No.: US 11,795,634 B2
(45) Date of Patent: Oct. 24, 2023

(54) INTELLIGENT AND TWO-DIMENSIONAL TRAFFIC MARKING SPRAYING DEVICE

(71) Applicant: Wuhan University of Technology, Wuhan (CN)

(72) Inventors: Nengchao Lyu, Wuhan (CN); Weichong Zhang, Wuhan (CN); Chaozhong Wu, Wuhan (CN); Jiaqiang Wen, Wuhan (CN)

(73) Assignee: WUHAN UNIVERSITY OF TECHNOLOGY, Wuhan (CN)

( * ) Notice: Subject to any disclaimer, the term of this patent is extended or adjusted under 35 U.S.C. 154(b) by 195 days.

(21) Appl. No.: 17/471,204

(22) Filed: Sep. 10, 2021

(65) Prior Publication Data

US 2022/0282433 A1 Sep. 8, 2022

(30) Foreign Application Priority Data

Mar. 2, 2021 (CN) ..... 202110230845.X

(51) Int. Cl.
*E01C 23/22* (2006.01)
*E01C 23/16* (2006.01)

(52) U.S. Cl.
CPC ..... *E01C 23/222* (2013.01); *E01C 23/163* (2013.01)

(58) Field of Classification Search
CPC ..... E01C 23/222; E01C 23/163; E01C 23/22
See application file for complete search history.

(56) References Cited

U.S. PATENT DOCUMENTS

| | | | | |
|---|---|---|---|---|
| 5,785,760 | A * | 7/1998 | Sconyers | B05B 7/1673 137/340 |
| 6,183,161 | B1 * | 2/2001 | Neeper | E01C 23/22 404/93 |
| 7,850,101 | B2 * | 12/2010 | Walmer | E01C 23/22 239/662 |
| 9,598,826 | B2 * | 3/2017 | Grimm | E01C 23/222 |
| 10,577,761 | B2 * | 3/2020 | Grimm | B05B 12/04 |
| 10,618,179 | B1 * | 4/2020 | See | B25J 19/04 |
| 11,504,733 | B1 * | 11/2022 | Alsafar | B05B 13/005 |
| 2014/0120251 | A1 * | 5/2014 | Grimm | B05B 13/005 118/696 |
| 2017/0151577 | A1 * | 6/2017 | Baltz | B05B 5/035 |
| 2020/0407929 | A1 * | 12/2020 | Falchetti | E01C 23/163 |
| 2021/0039308 | A1 * | 2/2021 | Flitsch | B33Y 50/02 |
| 2021/0172133 | A1 * | 6/2021 | Yamamoto | E01C 23/18 |
| 2022/0042258 | A1 * | 2/2022 | Dolinar | G06V 20/588 |
| 2022/0098804 | A1 * | 3/2022 | Wilkens | E01C 23/163 |

* cited by examiner

*Primary Examiner* — Abigail A Risic
(74) *Attorney, Agent, or Firm* — WPAT, PC

(57) ABSTRACT

An automatic and intelligent spraying device for traffic marking intelligent. The spraying device for traffic marking includes a fixed bottom plate, a coating storage tank, a control box provided with a controller, an armrest, a row of nozzles, a speed sensor, and a driving motor. The coating storage tank is connected with coating pipes equipped with an electromagnetic valve. The fixed bottom plate is provided with a driving motor and rotating wheels. The driving motor drives the rotating wheels to move. The speed sensor is electrically connected with the controller and the driving motor. The controller controls a speed of the driving motor according to speed information detected by the speed sensor. The controller controls the driving motor, and controls the row of nozzles to spray according to a preset spray marking and spray pattern through the electromagnetic valve.

9 Claims, 2 Drawing Sheets

INTELLIGENT AND TWO-DIMENSIONAL TRAFFIC MARKING SPRAYING DEVICE

REFERENCE TO RELATED APPLICATIONS

This application claims priority from Chinese Patent Application No. 202110230845X, filed on Mar. 2, 2021, the contents of which are hereby incorporated by reference in their entirety for all purposes.

TECHNICAL FIELD

This application relates to the field of traffic marking, and more specifically, to a device that spray traffic marking automatically and intelligently.

BACKGROUND

Traffic markings refer to the signs on the road surface that use lines, arrows, words, elevation marks, protruding road signs and contour signs to convey traffic information such as guidance, restriction and warning to traffic participants. Its function is to control and guide traffic. According to statistics, there are 1.834 million kilometers of traffic markings in China. The marking machine is a kind of pavement construction machinery which is widely used in roads, high-rise highways, parking lots, squares and runways to draw different restrictions, guidelines and warnings on the flat ground.

The existing technology has the following shortcomings: when drawing arrow, diamond icon, triangle icon, etc., the marking machine requires workers to set out by manual ruler measurement, fixed point and throwing rope, which not only affects the construction efficiency, but also may affect the project quality. After the lofting, skilled workers are needed to push the marking machine to move and spray, which requires high level of workers and has a high possibility of operation error. Once the marking error occurs, the wrong icon needs to be cleared and the marking again, which consumes a lot of labor and has low work efficiency.

Therefore, there is an urgent need to improve work efficiency in spraying traffic marking.

SUMMARY

The terms "invention", "the invention", "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to various examples, the device for spraying traffic marking includes fixed baseplate configured to paint storage box, control box, handrail, Drive motor and wheels. The device also includes a row of nozzles under the fixed baseplate.

According to certain examples, a row of nozzles are setted in the same line and arranged along the width direction of the fixed baseplate. A heat booster is arranged on the periphery of the nozzle, and the controller is electrically connected with the heater to control the opening and closing of the heater.

The device can spray traffic marking automatically and intelligently. It allows builders to select the required traffic markings on the control panel, and then the controller intelligently controls the opening and closing of each solenoid valve in combination with the information of the speed sensor to automatically spray the two-dimensional traffic markings, which reduces the construction amount of workers, avoids the operation errors and wastes time in the construction process, reduces the technical requirements for workers, and greatly improves the construction quality. It improves the work efficiency, reduces the labor cost, and improves the rationality and practicability of the device.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The following describes technical solutions of this application with reference to the accompanying drawings.

Figure 1:
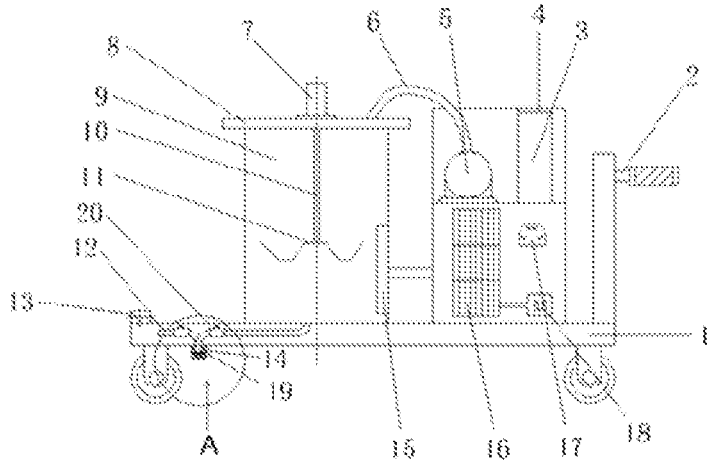
FIG. 1 is a diagram of traffic marking spraying device according to aspects of the present invention.

FIG. 1 illustrates a side view of a traffic marking spraying device according to examples of the present disclosure. The traffic marking spraying device includes the coating storage box 9, control box and armrest 2 are installed on the upper surface of the baseplate 1, wherein the paint storage box 9 and the control box are in the middle position of the upper surface of the baseplate 1, and the armrest 2 is at the right side of the upper surface of the fixed bottom plate 1. Meanwhile, a horizontal set partition board is installed in the inner cavity of the control box, which divides the control box into the upper and lower box, and the upper box is directly above the lower box; and The controller 3 air compressor 5 are installed in the upper box interval, and the upper surface of the controller 3 is provided with control panel 4. The top cover of the paint storage tank 9 is provided with a paint barrel cover 8, which is composed of two semi-circular covers; The mixing motor 7 is installed on the top outer wall of the paint barrel cover 8, one end of the air pipe 6 passes through the coating barrel cover 8 and is connected to the interior of the paint storage box 9, the other end is connected to the interior of the paint storage tank 9, at the same time, a plurality of paint pipes 12 are connected at the bottom of the paint storage tank 9, and each coating pipe 12 is equipped with a solenoid valve 20, and a row of nozzles 19 is connected at the bottom end of each coating pipe 12, Nozzle 19 is on the bottom of the retaining plate 1. In addition, a speed sensor 13 is installed on the left most of the upper surface of the fixed bottom plate 1, a drive motor 21 is installed at the bottom center of the fixed bottom plate 1, and a rotating wheel is installed at the four corner ends of the bottom of the fixed base plate 1, namely, the left front wheel 22, the right front wheel 23, the left rear wheel 24 and the right rear wheel 25. Meanwhile, the speed sensor 13 is electrically connected with the controller 3 and the driving motor 21 respectively, which is used to transmit the speed information of the drive motor 21 to the controller 3; The controller 3 is electrically connected with the drive motor 21 for controlling the speed of the drive motor 21 through the information fed back by the speed sensor 13. The drive motor 21 is connected with four rotating wheels respectively to drive the rotating wheel for moving. The left front wheel 22, the right front wheel 23, the left rear wheel 24 and the right rear wheel 25 are connected with the drive motor 21 through the shaft and gear respectively. The control input end of the drive motor 21 is connected with the controller 3, The controller 3 controls the speed of the drive motor 21 through the feedback information of the speed sensor 13 and the preset control circuit to realize the control of the speed. In addition, the controller 3 is electrically connected with the mixing motor 7 and the solenoid valve 20 respectively, which is used to control the opening or closing of the mixing motor 7, and the spray nozzle 19 is controlled by the solenoid valve 20 according to the preset spray marking and spraying pattern.

The lower box body is provided with a storage battery 16, a charging port 17 and a master switch 18. The storage battery 16 is electrically connected with the controller 3, the control panel 4, the air compressor 5, the mixing motor 7, the speed sensor 13, the drive motor 21 and the solenoid valve 20. The storage battery 16 supplies power to the intelligent two-dimensional traffic marking spraying device, and the charging port 17 charges the storage battery 16. The main switch 18 is electrically connected with the storage battery 16 to control the opening and closing of the storage battery 16. The storage battery 16 provides power for the whole device, and the charging port 17 is set to charge the storage battery 16. The main switch 18 controls the opening and closing of the storage battery 16, and the operation or stop of the whole device is achieved by opening or closing the main switch 18.

Meanwhile, the drive end of the mixing motor 7 is connected to the agitator 11 in the coating storage tank 9 through the drive shaft 10, and the mixing motor 7 is used to drive the agitator 11 to stir the coating in the coating storage tank 9. The control circuit in the controller 3 controls the operation of the stirring motor 7 according to the set time interval, and stirs the paint in the paint storage tank 9 through the stirrer 11, so that the paint is always in a uniform state.

It is necessary to note that in the present embodiment, both the controller 3 and agitator 11 adopt the structure in the prior art, and the specific structure and working principle of the controller are not described in detail here. Meanwhile, the controller 3 contains all the control circuits and preset traffic marking and patterns in the application. The control circuit is also a circuit in the existing technology. The control panel 4 is used for operators to select the required traffic marking. Air compressor 5 provides pressure for the paint to enter the nozzle 19 and spray. The device detects the forward distance according to the speed sensor 13, and automatically controls the opening and closing of the solenoid valve 20, thus forming two-dimensional marking and pattern on the road.

Further, in the present embodiment, a heating pipe 15 is installed on one inner wall of the paint storage box 9, and a temperature sensor is arranged in the heating pipe 15; The temperature sensor is electrically connected with the controller 3, which is used to transmit the temperature information of the coating in the detected paint storage box 9 to the controller 3. The controller 3 is electrically connected with the heating pipe 15 for controlling the opening and closing of the heating pipe 15. After opening the main switch 18, when the temperature of the added coating is too low, the heating pipe 15 starts, and the heating pipe 15 heats all the coatings by heat transfer; When the preset temperature is reached, the heating pipe 15 stops automatically, and repeat the process so that the paint in the paint storage tank 9 is always within a suitable temperature range.

Meanwhile, a heater 14 is installed on the periphery of the nozzle 19, and the controller 3 is electrically connected with the heater 14 to control the opening and closing of the heater 14, which is used to prevent the nozzle 19 from being blocked by coating solidification. When spraying begins, the high-pressure gas in the air compressor 5 enters the interior of the coating storage box 9 through the gas pipe 6, and the coating contained in the coating storage box enters the nozzle 19 through the coating pipe 12 and the solenoid valve 20, and the coating is sprayed from the nozzle 19. Through the control circuit, the controller 3 can intelligently control the opening and closing of the solenoid valve 20 to control the opening and closing of the nozzle 19, so as to spray two-dimensional traffic markings.

Specifically, in this embodiment, a row of nozzles 19 are spaced on the same straight line and arranged along the width direction of the fixed baseplate 1.

The working principle of the intelligent two-dimensional traffic marking spraying device is as follows:

When the road marking needs to be sprayed, the construction personnel first select the marking to be sprayed on the control panel 4, then set a starting point, align the trolley, and turn on the main switch 18; In the process of the car moving forward, the high-pressure gas in the air compressor 5 enters the interior of the paint storage box 9 through the air pipe 6, and the paint contained in the paint storage box enters the nozzle 19 through the paint pipe 12 and the solenoid valve 20, and the paint is ejected from the nozzle 19; At the same time, the solenoid valve 20 is opened and closed at the corresponding position through the feedback information of the speed sensor 13 and the control of the controller 3, so as to achieve the purpose of automatic and intelligent spraying of two-dimensional traffic markings.

In conclusion, with the help of intelligent two-dimensional traffic marking spraying device, the construction personnel can select the required traffic marking in the control panel 4, controller 3 then automatically spray the two-dimensional traffic marking line by intelligent control of the opening and closing of each solenoid valve 20 combined with the information of the speed sensor 13, thus reducing the construction quantity of the workers. It avoids the waste of time in the process of workers' operation, reduces the technical requirements for workers, greatly improves the construction quality, improves the work efficiency, reduces the labor cost, and improves the rationality and practicability of the device.

Figure 2:
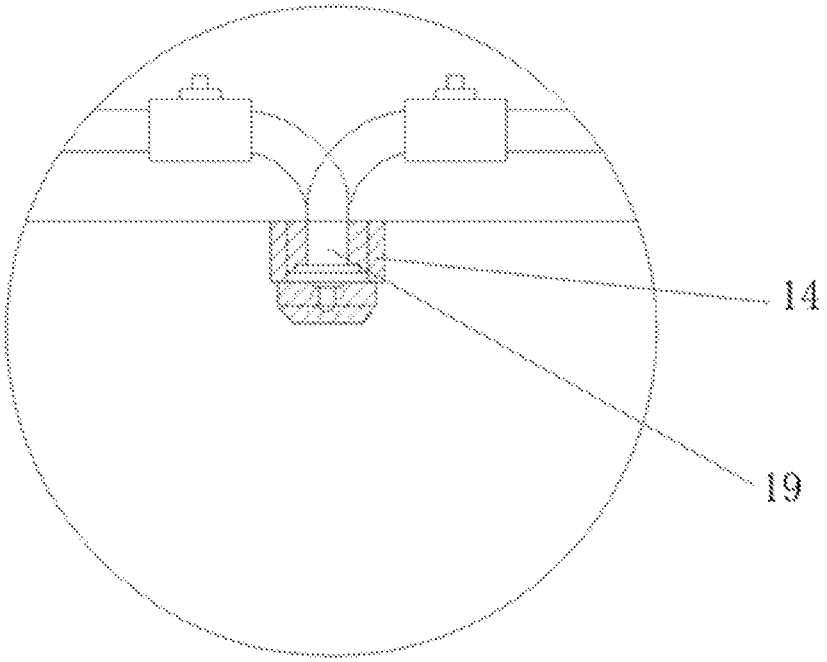
FIG. 2 is an enlarged diagram at A in FIG. 1.
Figure 3:
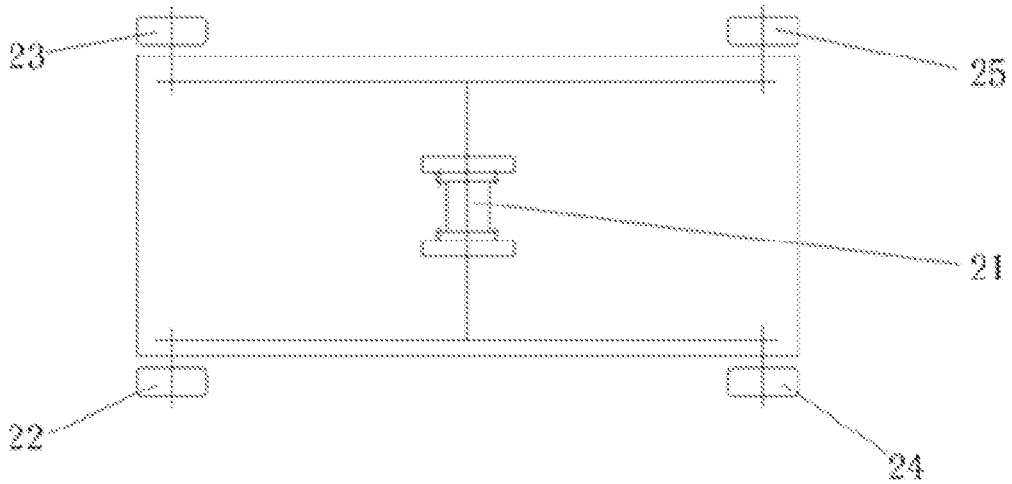
FIG. 3 illustrates the bottom structure of the device's fixed baseplate.
Figure 4:
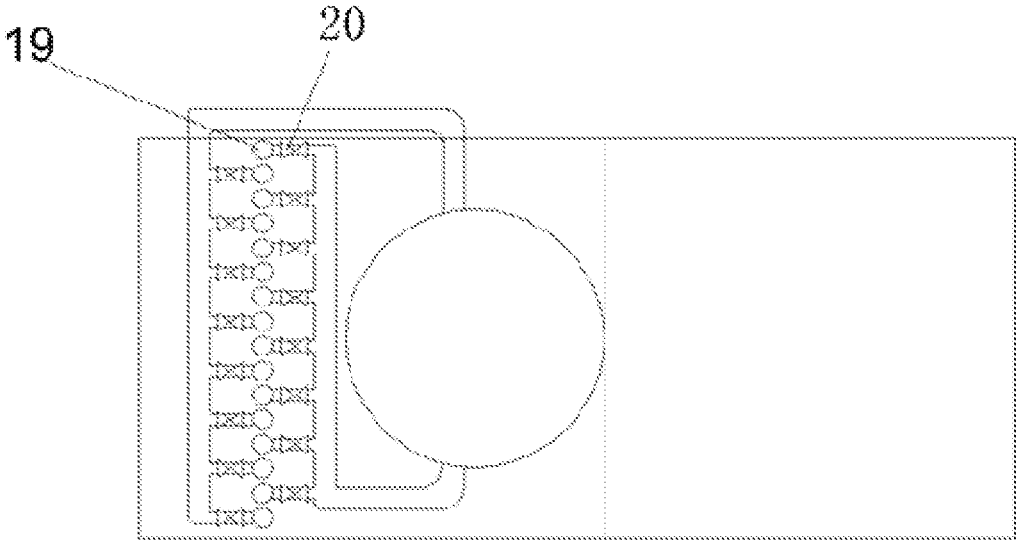
FIG. 4 illustrates the nozzle arrangement of fixed baseplate.

FIGS. 2-4 respectively illustrate an enlarged diagram at A in FIG. 1, the bottom structure of the device's fixed baseplate and the nozzle arrangement of fixed baseplate.

That which is claimed is:

1. An automatic and intelligent spraying device for traffic marking comprising:

a fixed bottom plate, a coating storage tank, a control box, an armrest, a row of nozzles, a speed sensor, and a driving motor, wherein the coating storage tank, the control box, and the armrest are arranged on an upper surface of the fixed bottom plate in turn and spaced;

the control box is divided into an upper box body and a lower box body, the upper box body is provided with a controller and an air compressor at intervals, and the coating storage tank is connected to the air compressor through a gas pipe;

the bottom of the coating storage tank is connected with a plurality of coating pipes, each coating pipe is equipped with an electromagnetic valve, and a bottom end of each coating pipe is connected with the row of nozzles, the row of nozzles are located on the bottom of the fixed bottom plate;

the fixed bottom plate is provided with the speed sensor, the center of the bottom of the fixed bottom plate is provided with a driving motor, and four corner ends of the fixed bottom plate is provided with four rotating wheels;

the driving motor is respectively connected with the four rotating wheels for driving the four rotating wheels to move;

the speed sensor is electrically connected with the controller and the driving motor respectively for transmitting speed information of the driving motor to the controller;

the controller is electrically connected with the driving motor, and is used to control a speed of the driving motor through the feedback speed information of the speed sensor;

the controller is electrically connected with the driving motor and the electromagnetic valve respectively to control the opening or closing of the driving motor, and control the row of nozzles to spray according to a preset spray marking and spray pattern through the electromagnetic valve.

2. The spraying device for traffic marking of claim 1, wherein the armrest is fixedly installed on an upper right side of the fixed bottom plate.

3. The spraying device for traffic marking of claim 1, wherein the lower box body is provided with a storage battery, a charging port and a master switch, the storage battery supplies power to the traffic marking spraying device, and the charging port charges the storage battery; the master switch is electrically connected with the storage battery for controlling the opening and closing of the storage battery.

4. The spraying device for traffic marking of claim 1, wherein the top of the coating storage tank is provided with a stirring motor, and a drive end of the stirring motor is connected to a stirrer inside the coating storage tank, and the stirring motor is used to drive the stirrer to stir the coating in the coating storage tank.

5. The spraying device for traffic marking of claim 4, wherein the top cover of the paint storage tank is provided with a coating barrel cover, the stirring motor is installed on a top outer wall of the coating barrel cover, one end of the air pipe passes through the coating barrel cover and is connected to the interior of the coating storage tank.

6. The spraying device for traffic marking device of claim 1, wherein the traffic marking spray device further comprises heating pipes arranged on an inner wall of the coating storage tank, and a temperature sensor arranged in the heating pipes; the temperature sensor is electrically connected with the controller for transmitting detected temperature information of the coating in the coating storage tank to the controller; the controller is electrically connected with the heating pipes for controlling the opening and closing of the heating pipes.

7. The spraying device for traffic marking of claim 1, wherein the traffic marking spray device further comprises heat boosters arranged on a periphery of the nozzles, and the controller is electrically connected with the heat boosters to control the opening and closing of the heat boosters.

8. The spraying device for traffic marking of claim 3, wherein the storage battery is electrically connected with the controller, the air compressor, the stirring motor, the speed sensor, the driving motor and the electromagnetic valve respectively.

9. The spraying device for traffic marking of claim 1, wherein the row of nozzles are set on the same straight line and arranged along a width direction of the fixed bottom plate.

* * * * *